US008277522B2

(12) United States Patent
Jimeson et al.

(10) Patent No.: US 8,277,522 B2
(45) **Date of Patent: *Oct. 2, 2012**

(54) MIXED ALCOHOL FUELS FOR INTERNAL COMBUSTION ENGINES, FURNACES, BOILERS, KILNS AND GASIFIERS

(75) Inventors: Robert M. Jimeson, Vienna, VA (US); Mark C. Radosevich, Durango, CO (US); Rex R. Stevens, Grand Junction, CO (US); Geradelte Giardino-Radosevich, Durango, CO (US)

(73) Assignee: Standard Alcohol Company of America, Inc., Arvada, CO (US)

( * ) Notice: Subject to any disclaimer, the term of this patent is extended or adjusted under 35 U.S.C. 154(b) by 354 days.

This patent is subject to a terminal disclaimer.

(21) Appl. No.: 12/498,850

(22) Filed: Jul. 7, 2009
(Under 37 CFR 1.47)

(65) Prior Publication Data

US 2010/0024288 A1 Feb. 4, 2010

Related U.S. Application Data

(63) Continuation-in-part of application No. 11/060,169, filed on Feb. 17, 2005, now Pat. No. 7,559,961, which is a continuation-in-part of application No. 10/124,665, filed on Apr. 17, 2002, now Pat. No. 6,858,048.

(51) Int. Cl.
*C10L 1/18* (2006.01)

(52) U.S. Cl. ..... 44/452

(58) Field of Classification Search ..... 44/452
See application file for complete search history.

(56) References Cited

U.S. PATENT DOCUMENTS

| | | | | |
|---|---|---|---|---|
| 2,128,910 | A | 9/1938 | Bludworth | |
| 3,822,119 | A | 7/1974 | Frech | |
| 3,968,999 | A | 7/1976 | Keller | |
| 4,018,293 | A | 4/1977 | Keller | |
| 4,030,893 | A | 6/1977 | Keller | |
| 4,045,092 | A | 8/1977 | Keller | |
| 4,089,657 | A | 5/1978 | Keller | |
| 4,097,217 | A | 6/1978 | Keller | |
| 4,146,366 | A | 3/1979 | Keller | |
| 4,192,651 | A | 3/1980 | Keller | |
| 4,218,516 | A | 8/1980 | Meyer et al. | |
| 4,298,354 | A | 11/1981 | Hardman et al. | |
| 4,357,146 | A | 11/1982 | Heeren | |
| 4,366,032 | A | 12/1982 | Mikitenko et al. | |
| 4,384,872 | A | 5/1983 | Kester et al. | |
| 4,479,807 | A | 10/1984 | Rebandt | |
| 4,533,508 | A | 8/1985 | Stevens | |
| 4,561,861 | A | 12/1985 | Davis et al. | |
| 4,675,344 | A | 6/1987 | Conway et al. | |
| 4,705,532 | A | 11/1987 | Mazanec et al. | |
| 4,752,622 | A | 6/1988 | Stevens | |
| 4,752,623 | A | 6/1988 | Stevens | |
| 4,762,858 | A | 8/1988 | Hucul et al. | |
| 4,825,013 | A | 4/1989 | Quarderer et al. | |
| 4,831,060 | A | 5/1989 | Stevens et al. | |
| 4,871,397 | A | 10/1989 | Stevens | |
| 4,882,360 | A | 11/1989 | Stevens | |
| 4,895,662 | A | 1/1990 | Stevens | |
| 4,953,479 | A | 9/1990 | Keller et al. | |
| RE33,562 | E | 4/1991 | Badger | |
| 5,045,087 | A | 9/1991 | Keller | |
| 5,288,393 | A | 2/1994 | Jessup et al. | |
| 5,559,275 | A | 9/1996 | Barger | |
| 5,653,866 | A | 8/1997 | Jessup et al. | |
| 5,663,455 | A | 9/1997 | Harris et al. | |
| 5,720,784 | A | 2/1998 | Killick et al. | |
| 5,837,126 | A | 11/1998 | Jessup et al. | |
| 6,030,521 | A | 2/2000 | Jessup et al. | |
| 6,039,772 | A | 3/2000 | Orr | |
| 6,858,048 | B1 * | 2/2005 | Jimeson et al. | 44/452 |
| 7,559,961 | B2 * | 7/2009 | Jimeson et al. | 44/452 |

FOREIGN PATENT DOCUMENTS

| | | |
|---|---|---|
| CN | 1089299 | 7/1994 |

OTHER PUBLICATIONS

"The Economical Production of Alcohol Fuels From Coal-Derived Synthesis Gas", Quarterly Technical Progress Report No. 18, W. Virginia Univ. Research Corp., Apr. 1996, 15 ppgs.

"Dow Develops Catalytic Method to Produce Higher Mixed Alcohols", Technology, Nov. 12, 1984, pp. 29-30.

"Mixed Alcohols From Synthesis Gas", Dow Chemical, M.J. Mintz and G.J. Quarderer, pp. 1-21, Jan. 1986.

"Evaluation of Synthesis Gas Based High Octane Oxygenates" (The Mised Alcohols Option), Absel Elsawy and David Gray, Nov. 1988, pp. 119-136.

Letter w/enclosures from Lurgi GMBH to Wayne Kreis of The Texas Methanol Corp., dated Jan. 19, 1987, ref: Octamix-Sample Shipment of Jan. 17, 1987, Frankfurt, Germany, 3 pgs.

* cited by examiner

*Primary Examiner* — Cephia D Toomer

(74) *Attorney, Agent, or Firm* — Geoffrey A. Mantooth

(57) ABSTRACT

Mixed alcohol formulas can be used as a fuel additive in petroleum, synthetic or bio-derived gasoline, diesel fuels, jet fuel, aviation gasoline, heating oil, bunker oil, coal, petroleum coke or as a neat fuel in and of itself. The mixed alcohol formulations can also be utilized as a thinning agent to improve the transportation of heavy petroleum crude oils or bitumen produced from tar sands. The mixed alcohol formulations can contain combinations of two or more, three or more alcohols, or blend of $C_1$-$C_5$ alcohols, or $C_1$-$C_8$ alcohols or higher $C_1$-$C_{10}$ alcohols in order to boost energy content. The primary benefits of mixed alcohols are increased combustion efficiencies, improved fuel economies, reduced emissions profiles and low production costs. These improved combustion efficiencies result in increased miles per gallon of blended fuel.

49 Claims, No Drawings

MIXED ALCOHOL FUELS FOR INTERNAL COMBUSTION ENGINES, FURNACES, BOILERS, KILNS AND GASIFIERS

This application is a continuation-in-part of application Ser. No. 11/060,169, filed Feb. 17, 2005, now U.S. Pat. No. 7,559,961, which application was a continuation-in-part of Ser. No. 10/124,665, filed Apr. 17, 2002, now U.S. Pat. No. 6,858,048.

FIELD OF THE INVENTION

The present invention relates to mixed alcohol fuels used in internal combustion engines, furnaces and boilers, and in particular blended into gasoline fuels, diesel fuels, jet fuels, heating oil fuels, bunker oil fuels, synthetic or bio-produced fuels, petroleum coke and coal. Additionally, the mixed alcohol fuels may be utilized neat as a substitute fuel or as a higher BTU substitute for fermented ethanol or lingo-cellulosic ethanol when blended into E-85 type mixtures with gasoline. The mixed alcohol fuel may also be utilized as a thinning agent when blended into extra thick or heavy crude oils or tar sand bitumen heavy oils thus making it easier to transport in a pipeline or otherwise transport these thick, unrefined heavy crude oils.

BACKGROUND OF THE INVENTION

Internal combustion engines are commonly used on mobile platforms (to propel vehicles such as cars, trucks, airplanes, motorcycles, jet skis, snowmobiles), in remote areas (such as for oil well pumps or electric generators) or in lawn and garden tools (such as lawnmowers, weed-eaters, chainsaws, etc.). There are various types of internal combustion engines, furnaces, boilers, kilns and gasifiers.

Spark type engines utilize a volatile fuel, such as gasoline. A spark plug provides the source of ignition. A typical fuel is gasoline, either reformulated to meet mandated urban air quality standards or a non-oxygenated gasoline typically sold in rural areas. High performance spark type engines are sometimes tuned to operate on pure methanol or ethanol. Compression type engines take in air and compress it to generate the heat necessary to ignite the fuel. Typical compression engines also utilize longer-chained petroleum-derived diesel fuel, synthetically-produced (Fischer-Tropsch) diesel fuel or bio-diesel fuels produced from either animal fats or plant oils.

When gasoline is burned, it produces pollutants in the form of hydrocarbons (HC), nitrogen oxides (NOx), carbon monoxide (CO) and soot (particulates). In addition, gasoline in warm climates tends to evaporate due to the presence of volatile organic compounds (VOCs).

Internal combustion diesel engines are commonly used in vehicles operating both on-road for transportation and in off-road configurations for construction.

Furnaces and boilers are typically used for home or space heating, electrical generation or propulsion of large ships. Kilns are drying devices. Smaller kilns are used in the manufacture of pottery and ceramics. Larger kilns are used to dry lumber or manufacture cement. Gasifiers are devices which convert solid carbonaceous fuels into CO & $H_2$ synthesis gas which is either combusted or further catalyzed into liquid chemical or fuel products.

When diesel, lower distillates, petroleum coke or coal is combusted, these fossils produce pollutants in the form of hydrocarbons (HC), nitrogen oxides (NOx), carbon monoxide (CO) and soot (particulates). Nitrogen oxides and volatile organic components react together in sunlight to form ground level ozone, a component of smog. Diesel has less of a tendency to evaporate than does gasoline. Lower distillate heating oils, bunker oils, coke or coal have even less tendency to evaporate VOC's.

In areas of high use, such as heavy automobile traffic, exhaust emissions from internal combustion engines, furnaces, boilers or kilns plus evaporation from the fuel tanks result in significant air pollution. In some urban areas, a brown haze of pollution frequently hugs the first several hundred feet off of the ground.

Alcohol fuel additives have come into use for internal combustion engines as an oxygenate to further increase combustion efficiencies of petroleum distillates in order to reduce harmful emissions. In the 1970's, gasohol, a blend of mostly gasoline with some fermented ethanol, was introduced during the Arab oil embargo to extend supplies of gasoline. Unfortunately, at that time, many of the elastomeric engine seals, hoses and gasket components were designed only for gasoline or diesel and deteriorated with the use of ethanol. Since then, engines, gaskets and fuel delivery systems have become equipped with fluorinated elastomers, which are tolerant to the greater solvent characteristics of oxygenated alcohol fuels.

Today, the primary alcohol fuel is ethanol, which is typically fermented from grain (corn, wheat, barley, oats, sugar beets, etc.) in a fermentation process. Other versions of ethanol are now being produced through conversion of lignin and cellulose obtained from plant stalks or wood chips and termed as ligno-cellulosic ethanol. The ethanol is typically blended into gasoline in various quantities. "Premium" gasoline, with a higher (Research Octane+Motor Octane)/2 (also known as (R+M)/2) octane rating than "regular" gasoline, is primarily gasoline with 10% to 15% volumes of ethanol ($C_2$ alcohol). Another ethanol fuel is E-85, which is 85% ethanol and 15% gasoline. Still another alcohol fuel is M-85, which is 85% methanol ($C_1$ alcohol) and 15% gasoline.

Grain ethanol is expensive to produce. Ligno-cellulosic ethanol is even more expensive to produce. Furthermore, producing sufficient quantities of grain ethanol to satisfy the needs of the transportation industry is not practical because traditional food crops are diverted into fuel. Traditionally, grain ethanol has been heavily subsidized by governments. Droughts and government policy towards farming in general (less intervention and payments to farmers) make the supply of grain ethanol uncertain and expensive.

In addition, both ($C_1$) methanol and ($C_2$) ethanol (defined as lower alcohols) have less energy content when compared to gasoline. Methanol contains about 56,000 Btu's/gallon and ethanol contains about 75,500 BTU's/gallon while gasoline contains about 113,000 BTU's/gal. A motorist notices this when a vehicle running on gasoline achieves more miles per gallon than does a similar vehicle running on a blend of gasoline and lower alcohol fuels.

Some time ago, lead was added to gasoline to boost its octane rating. The octane rating relates to antiknock properties of gasoline. Lead is being eliminated from gasoline for environmental and health reasons. Since the early 1980's gasoline sold in the United States and many other countries has been blended with 5-15% volumes of methyl-tertiary-butyl-ether (MTBE), an oxygenate, in order to raise the octane rating and to reduce environmentally harmful exhaust emissions.

Unfortunately, MTBE is itself a pollutant, having an objectionable odor and taste and having been classified as a potential human carcinogen. To make matters worse, many gasoline storage tanks have developed leaks. MTBE is highly soluble in water and is low in biodegradability. MTBE features a tertiary carbon bond in its molecule which is difficult for natural organisms, such as bacteria or phytoplankton to break down. Consequently, MTBE has polluted the ground water in many communities. Several U.S. states, including California, have phased out the use of MTBE. This phase out will likely result in an eventual ban of MTBE in the USA and in other countries.

The presently planned replacement for MTBE is fermented grain ethanol, but as discussed above, producing the necessary quantities of grain ethanol or ligno-cellulosic varieties of ethanol to replace MTBE will be problematic in specific regions.

Therefore an effective replacement for MTBE in gasoline is needed. In addition, a fuel is needed to reduce harmful combustion emissions from diesel fuel, jet fuel, lower distillate petroleum fuels, coke and coal to reduce particulate soot, hydrocarbons and carbon monoxide. Furthermore, larger quantities of a higher energy content alcohol fuel are needed than can be produced from grain, lignin and cellulosic fermentation for the production of ethanol.

MMT, Methylcyclopentadienyl Manganese Tricarbonyl, has been a controversial gasoline additive for many years. MMT was initially used by refiners in the 1970's chiefly to increase octane but studies have shown that while increasing octane, MMT increases emissions, fouls spark plugs and emission control systems. MMT like MTBE usage is declining in North America and in other developed countries. Higher mixed alcohols can substitute for the octane increase of MMT while additionally working as an even more effective oxygenate to improve combustion efficiency which reduces exhaust emissions which typically increases fuel economy instead of reducing miles per gallon.

SUMMARY OF THE INVENTION

The present invention provides a fuel for use in internal combustion engines, comprising gasoline and a mixture of alcohols comprising by volume: 0.01-55% methanol, 0.01-80% ethanol, 0.01-35% propanol, 0.01-30% butanol, 0.01-20% pentanol, 0.01-15% hexanol, 0.01-13% heptanol, 0.01-10% octanol.

In accordance with one aspect of the present invention, the fuel contains at least 5% by volume of the mixed alcohols and the octane number of the gasoline fuel is greater than 90.

In accordance with another aspect of the present invention, the mixture of alcohols comprises 5-50% of the fuel by volume.

In accordance with another aspect of the present invention, the higher mixed alcohols further comprise by volume: 0.01-6% nananol and 0.01-5% decanol.

The present invention provides a fuel for use in internal combustion engines, comprising gasoline and two alcohols taken from the group, with percentages by volume: 0.01-55% methanol, 0.01-80% ethanol, 0.01-35% propanol, 0.01-30% butanol, 0.01-20% pentanol, 0.01-15% hexanol, 0.01-13% heptanol, 0.01-10% octanol.

In accordance with one aspect of the present invention, the fuel contains at least 5% by volume of the mixed alcohols and the octane number of the gasoline fuel is greater than 90.

In accordance with another aspect of the present invention, the mixture of alcohols comprises 5-50% of the fuel by volume.

In accordance with another aspect of the present invention, the group of alcohols further comprises by volume: 0.01-6% nananol and 0.01-5% decanol.

In accordance with another aspect of the present invention, at least three alcohols are taken from the group.

The present invention provides a fuel for use in diesel engines, comprising diesel and higher mixed alcohols comprising by volume: 01-55% methanol, 0.01-80% ethanol, 0.01-35% propanol, 0.01-30% butanol and 0.01-20% pentanol.

In accordance with one aspect of the present invention, the mixed alcohols comprise 2-30% of the diesel fuel by volume.

In accordance with another aspect of the present invention, the mixed alcohols comprise, by volume: 0.01-15% hexanol, 0.01-13% heptanol, and 0.01-10% octanol.

In accordance with another aspect of the present invention, the mixed alcohols further comprise by volume: 0.01-6% nananol and 0.01-5% decanol.

In accordance with another aspect of the present invention, the diesel comprises synthetic diesel.

In accordance with another aspect of the present invention, the diesel comprises biodiesel.

The present invention provides a fuel for use in diesel engines, comprising: diesel and two alcohols taken from the group, with percentages by volume: 0.01-55% methanol, 0.01-80% ethanol, 0.01-35% propanol, 0.01-30% butanol and 0.01-20% pentanol.

In accordance with one aspect of the present invention, the mixed alcohols comprise 2-30% of the diesel fuel by volume.

In accordance with another aspect of the present invention, the group of alcohols further comprises, by volume: 0.01-15% hexanol, 0.01-13% heptanol and 0.01-10% octanol.

In accordance with another aspect of the present invention, the group of alcohols further comprises by volume: 0.01-6% nananol and 0.01-5% decanol.

In accordance with another aspect of the present invention, the diesel comprises synthetic diesel.

In accordance with another aspect of the present invention, the diesel comprises biodiesel.

In accordance with another aspect of the present invention, at least three alcohols are taken from the group.

The present invention provides a mixed alcohol neat fuel for use in an internal combustion engine, comprising, by volume: 0.01-55% methanol, 0.01-80% ethanol, 0.01-35% propanol, 0.01-30% butanol and 0.01-20% pentanol.

In accordance with one aspect of the present invention, the fuel further comprises, by volume: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

The present invention provides a mixed alcohol neat fuel for use in an internal combustion engine, comprising any two alcohols, by volume, taken from the group: 0.01-55% methanol, 0.01-80% ethanol, 0.01-35% propanol, 0.01-30% butanol and 0.01-20% pentanol.

In accordance with one aspect of the present invention, the group of higher mixed alcohols further comprises, by volume: 0.01-15% hexanol, 0.01-13% heptanol and 0.01-10% octanol.

In accordance with another aspect of the present invention, the group of higher mixed alcohols further comprises by volume: 0.01-6% nananol and 0.01-5% decanol.

In accordance with another aspect of the present invention, at least three alcohols are taken from the group.

The present invention provides a jet fuel for use in a jet turbine engine, comprising: kerosene and a mixture of alcohols comprising by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

The present invention provides a jet fuel for use in a jet turbine engine, comprising: kerosene and two alcohols taken from the group with percentages by volume: 0.01-55% methanol, 0.01-80% ethanol, 0.01-35% propanol, 0.01-30% butanol and 0.01-20% pentanol.

In accordance with one aspect of the present invention, the group of higher mixed of alcohols further comprises: 0.01-15% hexanol, 0.01-13% heptanol and 0.01-10% octanol.

In accordance with another aspect of the present invention, the group of higher mixed alcohols further comprises by volume: 0.01-6% nananol and 0.01-5% decanol.

In accordance with another aspect of the present invention, at least three alcohols are taken from the group.

The present invention provides a fuel for use in heating furnaces or boilers, comprising: heating oil and mixed alcohols comprising by volume: 0.01-55% methanol, 0.01-80% ethanol, 0.01-35% propanol, 0.01-30% butanol and 0.01-20% pentanol.

In accordance with one aspect of the present invention, the mixed alcohols by volume, further comprises: 0.01-15% hexanol, 0.01-13% heptanol and 0.01-10% octanol.

The present invention provides a fuel for use in heating furnaces or boilers, comprising: heating oil and two alcohols taken from the group, with percentages by volume: 0.01-55% methanol, 0.01-80% ethanol, 0.01-35% propanol, 0.01-30% butanol and 0.01-20% pentanol.

In accordance with one aspect of the present invention, the higher mixed alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

In accordance with another aspect of the present invention, at least three alcohols are taken from the group.

The present invention provides a fuel for use in heating furnaces and boilers, comprising: bunker oil and mixed alcohols comprising by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

The present invention provides a fuel for use in heating furnaces and boilers, comprising: bunker oil and two alcohols taken from the group, with percentages by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

In accordance with another aspect of the present invention, at least three alcohols are taken from the group.

The present invention provides a fuel for a furnace, kiln, boiler or gasifier, comprising: coke particles and mixed alcohols comprising by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

The present invention provides a fuel for a furnace, kiln, boiler or gasifier, comprising: coke particles and two alcohols taken from the group, with percentages by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

In accordance with another aspect of the present invention, at least three alcohols are taken from the group.

The present invention provides a fuel for a furnace, kiln, boiler or gasifier comprising: coal particles or coal slurry and mixed alcohols comprising by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

The present invention provides a fuel for a furnace, kiln, boiler or gasifier comprising: coal particles or coal slurry and two alcohols taken from the group, with percentages by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the higher mixed alcohols further comprise by volume: 0.01-6% nananol and 0.01-5% decanol.

In accordance with another aspect of the present invention, at least three alcohols are taken from the group.

The present invention provides a hydrocarbon blendstock comprising crude oil or bitumen and mixed alcohols, comprising, by volume: 0.01-55% methanol, 0.01-80% ethanol, 0.01-35% propanol, 0.01-30% butanol and 0.01-20% pentanol.

In accordance with one aspect of the present invention, the mixture of higher alcohols by volume, further comprises: 0.01-15% hexanol, 0.01-13% heptanol and 0.01-10% octanol.

In accordance with another aspect of the present invention, the mixture of higher alcohols by volume, further comprises 0.01-6% nananol and 0.01-5% decanol.

The present invention provides a hydrocarbon blendstock comprising crude oil or bitumen and two alcohols taken from the group, with percentages by volume: 0.01-55% methanol, 0.01-80% ethanol, 0.01-35% propanol, 0.01-30% butanol and 0.01-20% pentanol.

DESCRIPTION OF THE PREFERRED EMBODIMENTS

The present invention provides mixed alcohols that can be used as an additive to gasoline-based fuels, diesel-based fuels or jet fuels in internal combustion engines. In addition, the mixed alcohols can be used as "neat," that is without blending into gasoline, diesel or jet fuel.

When used as an additive to gasoline-based fuels, the mixed alcohols can be used as a substitute for MTBE, MMT, lead and/or for grain ethanol or ligno-cellulosic ethanol as an octane booster. The gasoline-based fuel is either reformulated or non-reformulated gasoline and mixed alcohols. The mixed alcohols also function as an oxygenate providing increased combustion efficiency to the base hydrocarbon fuels. The mixed alcohols also function to minimize water contamination of fuels. The mixed alcohol fuel, when combusted in an internal combustion engine, reduces hydrocarbon and carbon monoxide emissions, while having an increased octane number and a more stabilized Reid Vapor Pressure. In addition, carbon deposits on engine intake valves, exhaust valves, pistons and the combustion chambers of the furnaces and combustion boilers are significantly reduced.

When used as an additive to diesels, such as petroleum diesel, synthetic diesel, and/or biodiesel (plant oils or animal fats), fuels, the mixed alcohols function as an oxygenate. The present invention provides a diesel-based fuel that can be used in internal combustion engines. The diesel-based fuel is diesel and mixed alcohols. The fuel, when combusted in an internal combustion engine, reduces exhaust emissions. A unique property of mixed alcohols is that these longer-chained higher alcohols as a volumetric blend will solubilize with and enhance the combustion efficiencies of both liquid and solid fuels.

The diesel can be obtained form a variety of sources. Petroleum diesel is obtained from crude oil. Biodiesel is obtained from plant oils and/or animal fats. Synthetic diesel, just like synthetic higher alcohols, can be obtained from coal, methane natural gas, biomass, such as wood, garbage, sewage or natural gas; a biomass-to-liquid (BTL) process or gas-to-liquid (GTL) process may be used.

When the higher mixed alcohols are used "neat," without gasoline, jet fuel or diesel, the internal combustion engine exhibits reduced tailpipe emissions.

The mixed alcohols fuels can be used in a variety of internal combustion engines in automobiles, trucks, motorcycles, aircraft, stationary turbines and smaller engines such as those used in lawnmowers, jet skis, snowmobiles and hand-held tools such as chainsaws or weed-eaters.

Currently the ethanol based fuel E-85 is used in flexible fuel vehicles (FFV). The mixed alcohol fuels can be used in such FFV-equipped vehicles. Slight tuning or adjustment of the engine's spark ignition timing and air/fuel ratio may provide extra power and even lower emission profiles.

The blend of higher mixed alcohols contain single-chained or branched molecular alcohols having different numbers of carbon atoms. There are various types of alcohols, which are classified according to the number of carbon atoms. For example, methanol ($C_1$) has one carbon atom, ethanol ($C_2$) has two carbon atoms, n-propanol or iso-propanol ($C_3$) has three carbon atoms and so on. The alcohols are preferably normal and are designated n-propanol, n-butanol, n-pentanol, etc. Although the present invention discusses normal straight-chain alcohols, iso-alcohols such as iso-butanol could be used as well.

The mixed alcohols of the present invention comprise a number of alcohols. Typically, methanol and ethanol together comprise over 50%, by volume of the mixed alcohols, with other higher alcohols and small amounts of non-alcohol components making up the remainder. A typical mixture of mixed alcohols is, by volume:

0.01-55% methanol
0.01-80% ethanol
0.01-35% propanol
0.01-30% butanol
0.01-20% pentanol (I).

Another mixture of mixed alcohols is, by volume:

0.01-55% methanol
0.01-80% ethanol
0.01-35% propanol
0.01-30% butanol
0.01-20% pentanol
0.01-15% hexanol
0.01-13% heptanol
0.01-10% octanol (II).

Still another mixture of mixed alcohols is, by volume:

0.01-55% methanol
0.01-80% ethanol
0.01-35% propanol
0.01-30% butanol
0.01-20% pentanol
0.01-15% hexanol
0.01-13% heptanol
0.01-10% octanol
0.01-6% nananol
0.01-5% decanol (III).

Formula II of mixed alcohols contains $C_1$-$C_8$. This formula II is used with gasoline. In one embodiment, the fuel contains at least 5% of volume of the mixed alcohols and the octane number of the gasoline is greater than 90. In another embodiment, the fuel contains 5-50% by volume mixed alcohols.

In another embodiment, the formula III is used with gasoline.

Typically, the amount of ethanol exceeds the amount of methanol. In fact, the mixed alcohols may contain the highest proportion of ethanol, with the other alcohols comprising smaller proportions. $C_2$ ethanol provides more energy density than does $C_1$ methanol. Typically, the energy density increases with the increasing carbon content in the higher alcohols. The higher alcohols $C_3$-$C_8$ (propanol, butanol, pentanol, hexanol, heptanol and octanol) provide more energy density than do the lower alcohols $C_1$-$C_2$.

Traditionally, the use of ethanol as an additive to petroleum-based fuels has resulted in a blended fuel which displays a lower energy density (measured in BTU/lb or BTU/gal) than does petroleum-based fuel without ethanol. Thus, the miles per gallon which can be achieved by a typical internal combustion engine powered vehicle is slightly lower when using an ethanol and hydrocarbon-based fuel (such as gasoline) blend than when using fuel without ethanol. However, with the present invention, the use of higher alcohols $C_3$-$C_8$ increases the energy density of the alcohol mixture. Thus, less energy loss is incurred when using the mixed alcohols as a fuel additive. In fact, the mixed alcohols can contain higher alcohols such as $C_9$, $C_{10}$ and this blend of higher mixed alcohols in gasoline typically improves fuel mileage economy while creating a highly reduced emissions profile.

The use of $C_6$-$C_8$ alcohols, while preferred, is optional. Thus, the mixed alcohols blended into gasoline can contain $C_1$-$C_2$ alcohols only or a mixture of any two or more of the alcohols in the $C_1$-$C_5$ range. Upon combustion, mixed $C_1$-$C_5$ alcohols in combination with gasoline produces lower emissions of hydrocarbons and carbon monoxide relative to gasoline-only type fuels. The mixed alcohols ($C_1$-$C_2$ or $C_1$-$C_5$ or $C_1$-$C_8$ or $C_1$-$C_{10}$) can be blended manually by providing the various components in the proper proportions. Alternatively, the mixed alcohols can be synthesized in large commercial quantities. For example, the mixed alcohols can be made by passing synthesis gas over a potassium-promoted $CoSMoS_2$ catalyst at about 1500 psig and 300 degrees C. This process is more fully described in U.S. Pat. Nos. 4,752,622 and 4,882,360.

The mixed alcohols can contain some slight impurities due to the manufacturing process. Such impurities include esters, water and trace amounts of hydrocarbons. These impurities can be removed if required by the particular application or left within the blend of mixed alcohols.

This mixture of both higher ($C_3$ plus) and lower alcohols ($C_1$ and $C_2$) when synthetically produced will typically have a greater volume of ethanol than any other alcohol contained within the blend. The mixed alcohol chain of $C_3$ propanol to $C_8$ octanol or $C_{10}$ decanol typically is produced in a descending volumetric order and provides a greater energy density of 90,400 BTU's/gallon when compared to $C_2$ ethanol at 75,500 BTU's/gallon or $C_1$ methanol at 56,000 BTU's/gallon.

While advantageous to utilize this entire mixture of lower and higher mixed alcohols either neat or as a blendstock to petroleum-derived fuels, synthetically derived liquid fuels or bio-derived (plant oils or animal fat) fuels produced through transestrification or depolymerization techniques, the blend of mixed alcohols may also be fractionalized and distilled into individualized elements.

For certain applications either neat or as a blendstock, mixed alcohols may be further defined as a mixture of two or more component alcohols characterized by either "normal" (straight-chain molecular configurations) or as "iso" as a branched alcohol molecule. Isolating individual components from this blend of mixed alcohols can be achieved by fractional distillation. Then, the individual alcohols may be mechanically re-combined to form a mixture of methanol and ethanol only. Or a blend of ethanol, propanol and butanol only, etc. While this technique of isolating component alcohols and re-blending only portions of them is expensive, for certain applications it may be deemed appropriate. Thus mixed alcohols can be broadly defined as a blend of two or more component alcohols be they straight-chain normal alcohols or iso-branched alcohols produced either through fermentation or catalytic synthesis.

Note that the mixed alcohols are both water soluble and oil soluble, coal soluble, pet-coke soluble, biodegradable and function as excellent water solubilizers. Methanol has long been added to gasoline tanks to solubilize with condensate water. When there is too much water however, the methanol-bound water can phase-separate from the hydrocarbon-base fuel. This can cause engine problems such as engine stalling. An engine can tolerate some water in the fuel, so long as it is well mixed. The use of the higher alcohols ($C_3$-$C_8$ or $C_3$-$C_{10}$) serve to mitigate separation of the contaminant water in the fuel. A blend of higher alcohols will solubilize and bind condensate water much tighter than conventional, lower $C_1$-$C_2$ alcohols do.

The mixed alcohols in accordance with formula I can be blended into diesel fuel and jet fuel, as well as heating oil, bunker oil, petroleum coke or coal. In addition, the mixed alcohols of formula I can be used neat. The mixed alcohols of formulas II and III can be blended into diesel fuel, jet fuel, heating oil, bunker oil, petroleum coke or coal and can be used neat as well.

When used with diesel, the mixed alcohol of formula I comprises 2-30% of the diesel fuel by volume.

Still another formula of mixed alcohols is:

Any two alcohols selected from the group of, by volume:
- 0.01-55% methanol
- 0.01-80% ethanol
- 0.01-35% propanol
- 0.01-30% butanol
- 0.01-20% pentanol (IV).

For example, such a mixture can contain an ethanol or methanol plus another alcohol, such as $C_2$ and $C_3$, or $C_2$ and $C_4$, or $C_2$ and $C_5$, or $C_1$ and $C_3$, etc. Such a mixture can also contain alcohols higher than methanol and ethanol, such as $C_3$ and $C_4$, $C_3$ and $C_5$ or $C_4$ and $C_5$.

Another formulation of mixed alcohols is:

Any three alcohols selected from the group, by volume:
- 0.01-55% methanol
- 0.01-80% ethanol
- 0.01-35% propanol
- 0.01-30% butanol
- 0.01-20% pentanol (V).

For example, such a mixture can contain $C_1$, $C_2$ and $C_3$; or $C_2$, $C_3$ and $C_4$; or $C_3$, $C_4$ and $C_5$, or $C_2$, $C_4$ and $C_5$, etc.

Other formulas of mixed alcohols are:

Any two alcohols selected from the group, by volume:
- 0.01-55% methanol
- 0.01-80% ethanol
- 0.01-35% propanol
- 0.01-30% butanol
- 0.01-20% pentanol
- 0.01-15% hexanol
- 0.01-13% heptanol
- 0.01-10% octanol (VI).

Any three alcohols selected from the group, by volume:
- 0.01-55% methanol
- 0.01-80% ethanol
- 0.01-35% propanol
- 0.01-30% butanol
- 0.01-20% pentanol
- 0.01-15% hexanol
- 0.01-13% heptanol
- 0.01-10% octanol (VII).

Any two alcohols selected from the group, by volume:
- 0.01-55% methanol
- 0.01-80% ethanol
- 0.01-35% propanol
- 0.01-30% butanol
- 0.01-20% pentanol
- 0.01-15% hexanol
- 0.01-13% heptanol
- 0.01-10% octanol
- 0.01-6% nananol
- 0.01-5% decanol (VIII).

Any three alcohols or more selected from the group, by volume:
- 0.01-55% methanol
- 0.01-80% ethanol
- 0.01-35% propanol
- 0.01-30% butanol
- 0.01-20% pentanol
- 0.01-15% hexanol
- 0.01-13% heptanol
- 0.01-10% octanol 0.01-6% nananol
0.01-5% decanol (IX).

These formulas IV-IX can be used as substitutes for formulas I-III with gasoline, diesel fuel, jet fuel, neat, heating oil, bunker oil, petroleum coke or coal.

When using two or more alcohols, the alcohols can be mechanically mixed or combined. For example, production of alcohols using synthetic gas may result in a mixture of $C_1$-$C_8$ alcohols. The alcohols can be separated, such as by fractionalization or distillation. Then, the desired alcohols can be recombined.

Generally speaking, gasoline, jet and diesel fuels are primarily derived from crude oil and contain additives. Gasoline, jet fuel and diesel are all well known fuels. Jet fuel contains kerosene. Heating oil, grades 1 or 2, is used to heat homes or other structures. Lower distillate Bunker oil, grades A, B or C, is traditionally combusted in large ocean-going ships. Petroleum coke and coal are typically combusted in furnaces, kilns and boilers. Petroleum coke and coal also are used as process feedstocks for gasifiers.

The mixed alcohols can be blended with gasoline so as to make a blended fuel. The blended fuel can contain 0.01-99% by weight of mixed alcohols with the remainder being gasoline. Such a blended fuel features an enhanced octane. The mixed alcohols are a more effective octane enhancer than is either MTBE or ethanol for gasoline. Additionally, the higher alcohols feature a greater energy density than either ethanol or MTBE. The mixed alcohols are biodegradable in land and water environments. This is unlike MTBE, which persists and pollutes land and water environments. Mixed alcohols can be used as a direct replacement or substitute for MTBE in gasoline. Thus, when mixed alcohols are used in gasoline, MTBE need not be added to that gasoline.

In addition, the mixed alcohols can substitute for E-85 fuel blends (which are 85% grain ethanol or ligno-cellulosic ethanol and 15% gasoline). E-85 fuel blends are used in flex-equipped factory designed internal combustion engines, called Flex Fueled Vehicles (FFV's).

The gasoline is preferably unleaded gasoline, which is conventional and commercially available and marketed as reformulated or non-reformulated varieties. Gasoline is a well-known fuel comprising mixtures of aromatics, olefins and paraffins. Gasoline may be known in some countries by other terms, such as petrol or benzene. The boiling points of these hydrocarbons is typically 77-437 degrees F. Gasoline may also include additives, such as detergents, anti-icing agents, demulsifiers, corrosion inhibitors, dyes, deposit modifiers and octane enhancers (such as tetraethyl lead or MMT). As discussed above, global gasoline supplies are preferably unleaded (that is, containing little or no tetraethyl lead or MMT).

There are several different blends of unleaded gasoline currently refined and sold throughout the world. These are conventional gasoline, winter oxygenated gasoline and reformulated gasoline. Conventional gasoline is formulated with a lower Reid Vapor Pressure (RVP) in order to evaporate more slowly in hot weather thereby reducing smog. Winter oxygenated and reformulated gasolines may contain MTBE or may contain ethanol to produce a cleaner burning fuel. Winter gasolines typically feature higher Reid Vapor Pressures (up to 12 psi or higher) to assist with cold starts. Summer gasolines typically feature 8 psi Reid Vapor Pressure ratings.

The mixed alcohols can be used as a substitute for MTBE and/or ethanol in gasoline, such as reformulated gasoline and/or winter oxygenated gasoline.

In addition, conventional commercial gasoline typically has an octane number between 85 and 90. So called regular gasoline has an octane number (R+M)/2 of about 87 when sold at sea level or 85 octane when sold at higher elevations, while premium gasoline has an octane number typically greater than 90. The octane number is a measure of the resistance of the gasoline to premature detonation in the engine. Premature detonation wastes the energy in the fuel and can harm the engine. An engine that knocks or pings during operation is experiencing premature detonation. Using a gasoline with a higher octane number typically lessens or eliminates the knocking or pinging problem.

The mixed alcohols enhance the octane number of the fuel. This is particularly advantageous for aviation gasoline. Aviation gasoline is typically gasoline having a higher octane number (100 or greater) than automotive gasoline. Tetraethyl or tetramethyl lead is added to gasoline in order to produce the higher octane number required for aviation gasoline. Tetraethyl lead used to be added to automotive gasoline in order to raise the octane number. However, the use of lead in gasoline has been all but eliminated in the United States, Canada and several developed countries, with the common exception of aviation gasoline. Thus, the use of mixed alcohols can enhance the octane number of gasoline in order to produce aviation gasoline, without the use of harmful, poisonous lead.

In a preferred embodiment having a somewhat lower Btu range, tests were conducted on the following mixture of mixed alcohols, by volume:

28.6% methanol
47.0% ethanol
14.4% n-propanol
3.7% n-butanol
2.5% n-pentanol
3.8% esters (I).

The esters were methyl acetate (1.9%) and ethyl acetate (1.9%). The oxygen mass concentration for the above mixed alcohols is 34%.

When 5% volume of mixed alcohols containing $C_1$-$C_5$ alcohols were blended with 85 octane heptane and iso-octane reference fuels, which contained no other oxygenate, the (R+M)/2 blending octane number of the mixed alcohols was measured as 109. It is believed that the neat (R+M)/2 octane measurement number of higher mixed alcohols can exceed 135 under different blending conditions and volumetric concentrations. Test methods ASTM D 2699 and 2700 were used to determine octane number.

The Reid Vapor Pressure (RVP) of the mixed alcohols is low to mid-range. RVP is a measure of a fuel's propensity to vaporize or evaporate. The higher the RVP, the more vaporization. A lower RVP is preferred to prevent vapor lock and reduce evaporative emissions (such as summertime evaporation of fuel from fuel tanks). A higher RVP is preferred in cold seasons to improve cold starts of engines. Reformulated gasoline has an RVP of between 6.4-10.0 psi. The measured RVP of the mixed alcohols $C_1$-$C_5$ is 4.6 psi (using test method ATSM D 5191). The blending RVP's of MTBE and pure ethanol are 8-10 psi and 17-22 psi, respectively. Measured RVP's of mixed alcohols may differ from their blending RVP's. Some reformulated gasolines currently require 2% by weight of oxygen in the fuel. It is believed that the blending of the mixed alcohols into gasoline will not significantly raise the RVP of the blended gasoline. Experiments have shown that when greater volumes (such as 25% volumes) of mixed alcohols are blended into gasoline the RVP of gasoline remains essentially unchanged. 10% volumes of higher mixed alcohols may raise the RVP of gasoline upwards by 0.6 to 1 psi. Thus, the mixed alcohols can raise the oxygen content of the fuel without significantly raising the RVP. This, coupled with more energy density than competing oxygenates are two of the primary commercial strengths of higher mixed alcohols.

The volumetric energy content of the mixed alcohols ($C_1$-$C_5$) alone is lower than unoxygenated gasoline. However, the energy content of the mixed alcohols is greater than E-85. It is believed that by incorporating $C_6$-$C_8$ alcohols into the mixed alcohols, the energy density will grow even closer to that of gasoline. Thus, the use of mixed alcohols $C_1$-$C_8$ or $C_1$-$C_{10}$ with gasoline will produce the desired oxygen content (and resulting emissions reduction) while avoiding an energy penalty. A vehicle using a 10% volume blend of mixed alcohols $C_1$-$C_8$ and gasoline will provide about the same or even greater miles per gallon as when combusting gasoline alone.

The use of mixed alcohols and gasoline reduces intake valve deposits (IVD), exhaust valve deposits (EVD) and combustion chamber deposits (CCD). As the concentration of mixed alcohols increases relative to gasoline, the carbon deposits further decrease. Furthermore, there is not a problem with hydrocarbon sludge or varnish buildup in the engine's fuel system when using mixed alcohols. Engine oil lubricants may need to be changed to a lubricant which is better adapted to acidic combustion products.

Emission characteristics will now be described. Emission characteristics were obtained by combusting two fuels separately in a 3.8 L Buick LeSabre. The fuels were gasoline alone and a blend of 15% $C_1$-$C_5$ mixed alcohols (see (I) above) and 85% gasoline. The tests were performed in accordance with the U.S. Federal Test Procedure (FTP). The FTP refers to Code of Federal Regulations, Volume 40, "Protection of the Environment", herein incorporated by reference in its entirety. The engine was tuned to combust the gasoline alone. No adjustments were made to combust the blended fuel of mixed alcohols and gasoline.

A Clayton Model ECE-50 passenger dynamometer with a direct drive variable inertia flywheel system was used for testing. The inertia weight simulates equivalent weights of vehicles from 1000 pounds to 4875 pounds in 125 pound increments. The inertia weight and horsepower settings for the dynamometer were 3750 lb and 7.2 hp, respectively.

A positive displacement-type constant volume sampling system (CVS) was used to dilute the vehicle exhaust before collecting emission samples. A 10 inch diameter by 12 foot long stainless steel dilution tunnel was used with the CVS.

The vehicle hood was maintained fully open during all cycles, and was closed during the soak (turned off) periods. A cooling fan of 5,000 cfm was used in front of the test vehicle to provide air flow during all of the tests. During soaks, the fan was turned off.

For emission testing, the vehicles were operated over the Urban Dynamometer Driving Schedule (UDDS). The UDDS is the result of more than ten years of testing by various groups to translate the Los Angeles smog-producing driving conditions to dynamometer operations, and is a non-repetitive driving cycle covering 7.5 miles in 1372 seconds with an average speed of 19.7 mph. The maximum speed is 56.7 mph. An FTP consists of a cold start, 505 seconds, cold transient phase, followed immediately by an 867 seconds, stabilized phase. Following the stabilized phase, the vehicle was allowed to soak for ten minutes with the engine turned off before proceeding with a hot start, 505 seconds, hot transient phase to complete the test.

The emissions are mathematically weighted to represent the average of several 7.5 mile trips made from hot and cold starts. Exhaust emissions for the FTP cover the effects of vehicle and emission control system warmups as the vehicle is operated over the cycle. The stabilized phase produces emissions from a fully warmed up or stabilized vehicle and an emission control system, "Hot start" or "hot transient" phase emissions result when the vehicle and emission control systems have stabilized during operations, and are then soaked (turned off) for ten minutes.

Several of the regulated emissions (HC, CO) were reduced when the engine used the blend of mixed alcohols and gasoline. For gasoline alone, the total hydrocarbon emissions (THC) were 0.058-0.059 grams (g) per mile, while for the blend of mixed alcohols and gasoline, THC emissions were 0.032-0.070 grams per mile. Some of the THC emissions comprised methane. The non-methane hydrocarbon (NMHC) emissions were 0.049-0.054 grams per mile for gasoline alone and 0.030-0.067 grams per mile for the blend of mixed alcohols and gasoline. The CO emissions were 0.573-0.703 grams per mile for gasoline alone and 0.285-0.529 grams per mile for the blend of mixed alcohols and gasoline. The NOx emissions were 0.052-0.058 grams per mile for gasoline and 0.059-0.063 grams per mile for the blend of mixed alcohols and gasoline. Thus, the use of mixed alcohol significantly decreased carbon monoxide emissions, decreased hydrocarbon emissions and only slightly increased NOx emissions.

The use of mixed alcohols and gasoline slightly increased emissions of formaldehyde and acetaldehyde relative to gasoline alone. The formaldehyde emissions were 0.781-0.859 milligrams (mg) per mile for gasoline alone and 0.900-1.415 mg per mile for mixed alcohols and gasoline. The acetaldehyde emissions were 0.126-0.294 mg per mile for gasoline alone and 0.244-0.427 mg per mile for mixed alcohols and gasoline. It is believed that the presence of esters in the mixed alcohols contributed to the increase in formaldehyde and acetaldehyde. The esters can be removed from the mixed alcohols to reduce these emissions.

The mixed alcohols can be blended with jet fuel so as to make a blended fuel. Jet fuel is primarily kerosene with additives. The blended fuel can contain 0.01-30% by volume of the mixed alcohols, with the remainder being jet fuel. An attractive aspect of the mixed alcohols is that they solubilize condensate water which develops in the head space above jet fuel while pilots are flying at extra cold high altitudes.

The mixed alcohols can be blended with diesel so as to make a blended fuel. The blended fuel can contain 0.01-30% by volume of mixed alcohols with the remainder being diesel, synthetic diesel or bio-diesel. Diesel is a well-known fuel.

A mixed alcohols-diesel fuel blend containing 10% ($C_1$-$C_5$) mixed alcohols (see (I) above) and 90% petroleum-derived diesel fuel was tested. The results were as follows:

| Test Parameter | Test Method | Result |
|---|---|---|
| Specific Gravity | ASTM D 4052 | 0.7514 |
| Carbon/Hydrogen (wt %) | ASTM D 5291 | 80.86/12.92 |
| Cetane Number | ASTM D 613 | 43.4 |
| Sulfur Content | ASTM D 2622 | 354 PPM |
| Oxygen Content | ASTM D 5599 | 1.16 wt % |
| Heat of Combustion | ASTM D 240 | Btu/lb |
| Gross | | 19079.9 |
| Net | | 17933.1 |
| HFRR | ASTM D6079 | 205 microns |
| Boiling Distribution | ASTM D86 | ° F. |
| IBP | | 147.2 |
| 5% | | 175.3 |
| 10% | | 340.0 |
| 15% | | 404.1 |
| 20% | | 423.5 |
| 30% | | 445.7 |
| 40% | | 469.9 |

-continued

| Test Parameter | Test Method | Result |
|---|---|---|
| 50% | | 490.9 |
| 60% | | 512.2 |
| 70% | | 534.7 |
| 80% | | 559.1 |
| 90% | | 590.9 |
| 95% | | 615.6 |
| FBP | | 631.9 |
| Recovered % | | 98.3 |
| Loss % | | 0.5 |
| Residue % | | 1.2 |

The use of mixed alcohols in diesel will reduce the particulates produced during combustion. In addition, it is believed that regulated emissions (hydrocarbons, carbon monoxide and nitrogen oxides) will be reduced.

In order to better blend the water soluble mixed alcohols with diesel, a surfactant binder can be used. One such commercially available surfactant that is expected to work well is Octimax 4900 available from Octel Starion.

The mixed alcohols can be volumetrically blended with diesel as follows: 50% mixed alcohols, 50% diesel. A diesel engine operating on such a fuel blend would likely need a one-time adjustment of its fuel injectors to achieve the proper air-fuel mixture. Fleet vehicle applications could benefit in particular from such a fuel blend.

While engine and dynamometer tests were conducted using 10%, 20% and 30% volumes of $C_1$-$C_5$ mixed alcohol blend—it was determined that unadjusted diesel engines performed better on the 10% volume blend mixed alcohols. When the mixed alcohol is longer chain blend of $C_1$-$C_8$ or a $C_1$-$C_{10}$ blend—and utilized at only 5% and 6% volume concentrations with petroleum-derived diesel, no surfactant binder is necessary even in cold winter weather.

When combusting a longer chained blend of higher mixed alcohols at only 5% or 6% volumes, then all of the black smoke commonly associated with diesel engines under load disappears. Diesel drivers operating heavy 1-ton pickups, military-style Hummers and semi-trucks have recorded 22%, 24% and 28% increases in fuel economy with just 5-6% volume blends of $C_1$-$C_8$ higher mixed alcohols.

The blending of the mixed alcohols into gasoline or diesel can occur in a variety of manners. The mixed alcohols can be splash blended into tanker trucks or rail cars. The movement of the tankers during transport will fully blend or mix the higher mixed alcohols into the gasoline or diesel. Another way of blending is to add the mixed alcohols to the fuel tank of a vehicle which is to combust the fuel. Again, the movement of the tank as the vehicle moves is sufficient to mix the petroleum-based, synthetic or bio-based fuel with the higher mixed alcohols. Still another way is to meter the mixed alcohols into a tank under pressure with the petroleum-based, synthetic or bio-based fuels.

The mixed alcohols can be used as a neat fuel in internal combustion engines, furnaces and in boilers. That is to say, the mixed alcohols need not be blended with other hydrocarbon fuels for combustion. The air/fuel ratios of engines, furnaces or boilers may need to be tuned to operate on a mixture of alcohols alone as a neat fuel. The octane number of the neat mixed alcohol fuel is typically between 90 and 138 depending upon its $C_1$-$C_5$ or $C_1$-$C_8$ or $C_1$-$C_{10}$ formulation. The octane blending characteristics of the higher mixed alcohols are not linear.

Mixed alcohol's higher octane is particularly advantageous for aviation gasolines, which require an octane number from 100 to 120 or greater. In fact, an experimental aircraft made a transatlantic flight using ethanol alone. It is believed that the use of the mixed alcohols of the present invention, with its higher energy density and water solubilizing abilities, will become a superior aircraft fuel over ethanol because of the increased octane, energy density (BTU's per pound) and water-solubilizing characteristics.

Several tests were conducted on the neat fuel mixed alcohols (see (I) above) to determine octane number. It was determined that the neat mixed alcohols would not ping in research engines designed to measure ping or pre-ignition. The octane of the neat mixed alcohols exceeded the upper threshold of these research engines even after being severely rejetted.

In order to attempt to estimate the octane of the mixed alcohols, a test was conducted with the $C_1$-$C_5$ mixed alcohols blended at 5% volume with 85 octane reference fuel comprised of heptane and iso-octane. The research octane was measured at 118.9 using test method ASTM D 2699 and the motor octane was measured at 98.2 using test method ASTM D 2700. The calculated blended octane number (R+M)/2 was 108.6. Thus, 108.6 is a particular blending octane rating.

To further delineate an octane rating of the neat mixed alcohols of (I), a 50/50 mixture of iso-octane and heptane was used as a reference fuel reagent source with a known reference octane of 50. Then, the $C_1$-$C_5$ mixed alcohols were blended at 50% volume with iso-octane/heptane. The research engines needed to be rejetted before a ping could be detected in order to accommodate the measuring of an octane greater than 110. After rejetting, research octane was mathematically calculated at 148.8, motor octane was calculated at 126.8 and the (R&M)/2 blending octane number was 137.8, using the test methods described above. The research engine would still not ping and pre-detonate even after being rejetted to record octane levels of 120.

Experiments demonstrated that neat higher mixed alcohols $C_1$-$C_5$ formula provided a stand-alone octane above 130. The octane blending characteristics of the higher mixed alcohols are not linear. Therefore, the blending octane numbers provided by the $C_1$-$C_5$ or $C_1$-$C_8$ or $C_1$-$C_{10}$ blend of higher mixed alcohols will depend solely upon what hydrocarbon fuel products they are blended into and at what volume percentages.

Reid Vapor Pressure was measured at 4.6 psi using test method ASTM D 5191 for $C_1$-$C_5$ mixed alcohols. This mid-range Reid Vapor Pressure is particularly desired in warm climates where volatile organic compounds (VOC's) from evaporation of fuels is a source of pollution. The Reid Vapor Pressure of $C_1$-$C_5$ or $C_1$-$C_8$ higher mixed alcohols will typically be between 2.35-5.0 psi.

The heat of combustion of the $C_1$-$C_5$ neat fuel mixed alcohols was measured using test method ASTM D 240. The gross heat of combustion was 12,235 BTU/lb. and the net was 11,061 BTU/lb. It is believed that this is below the heat of combustion of gasoline. The use of $C_6$-$C_8$ alcohols in the neat fuel mixed alcohols have been experimentally demonstrated to further increase the heat of combustion to 90,400 Btu's per gallon, nearer to that of gasoline at 113,000 Btu's.

The drivability index was measured at 949 using test method ASTM D 86. It is preferred if the drivability index does not exceed 1250. Thus, the neat fuel mixed alcohols drivability index was well below the maximum amount.

A corrosion test was performed on the neat fuel mixed alcohols to determine compatibility with types of metals that might be used in an internal combustion engine. The corrosion test was conducted using test method ASTM D 4636. Iron, copper, aluminum, magnesium and cadmium showed zero milligrams of loss. This indicates that the neat fuel mixed alcohol is as good as gasoline or diesel or kerosene-based jet fuel in being compatible with engine components.

Other engine components are elastomers, which are used in seals, hoses, gaskets, etc. Internal combustion engines are typically equipped with fluorinated elastomers in the gaskets, hoses and seals which are better suited to alcohol type fuels than non-fluorinated elastomers. The test method for fluorinated elastomer compatibility was ASTM D 471. After 240 hours, run at 50 degrees C., the volume change (percentage) was +25.81-26.01; hardness change (in points) was −22--23; the tensile strength change (percentage) was −41.40--45.93; and the elongation change (percentage) was −0.5763--0.6937.

The mixed alcohols can also be used as a near-neat fuel in Flex Fueled Vehicles (FFV's). The blend could be 95% mixed alcohols and 5% gasoline, by volume. The 5% gasoline increases the alcohol's Reid Vapor Pressure for cold temperature starts.

Still another formulation of the mixed alcohols is, by weight:

0.01-55% methanol
0.01-80% ethanol
0.01-35% propanol
0.01-30% butanol
0.01-20% pentanol
0.01-15% hexanol
0.01-13% heptanol
0.01-10% octanol
0.01-6% nananol
0.01-5% decanol.

A particular embodiment of the mixed alcohols is, by weight:

17.1% methanol
49.0% ethanol
17.3% propanol
7.0% butanol
5.1% pentanol
3.2% hexanol
0.3% heptanol
0.1% octanol.

The above mixed alcohols can be used in gasoline, in diesel or neat as a substitute fuel.

In addition, the mixed alcohol as discussed above can be used in heating oil, grades 1 or 2. The blended fuel can contain 1-30% by volume of the mixed alcohols, with the remainder being heating oil. The fuel is used for heating. For example, the fuel is combusted to heat homes or other structures.

Heating oil is quite similar to diesel with different additives, such as water solubilizers, bacterial inhibitors and additives which reduce deposit formation. The heating oil fuel with the mixed alcohols can contain these additives or in the alternative, the mixed alcohols may take the place of these additives. Heating oil is a middle distillate and contains paraffins (alkanes) cycloparaffins (cycloalkanes), aromatives and olefins from about $C_9$-$C_{20}$.

The mixed alcohols discussed above can also be used in bunker oil, grades A, B or C. The blended fuel can contain 0.01-30% by volume of the mixed alcohols, with the remainder being bunker oil. The fuel is commonly used in marine vessels and is combusted to power the power plants. The vessel derives propulsion and electricity generation from combusting the fuel.

Bunker oil is the most thick and sticky of the lower distillate residual fuels just ahead of the remaining portions which are utilized to produce asphalt. Bunker A and B oils are lighter than Bunker C. Bunker C is produced by blending the oil remaining after the refining process with lighter oil.

When blending the mixed alcohols with either heating oil or bunker oil, a mixing agent or surfactant binder can be used to prevent separation of the alcohols from the oil. One such surfactant is Octimax 4900, discussed above. Other commercial surfactant binders are also available. No surfactant binders are necessary when mixed alcohols are blended into gasoline or jet fuel.

Use of mixed alcohols blended with heating oil or bunker oil serves to mitigate air, water and land pollution.

The mixed alcohols can also be blended with finely ground petroleum coke or coal solid particles. The result is a coke-alcohol slurry or coal-alcohol slurry which can be pipelined, stored in tanks, or transported by rail, tanker ship or barge. Typically the coke or coal particles are less than or equal to 200 microns in size (for example, the particles can pass through a 100 mesh screen). The coke or coal is preferably ground in a mixed alcohol bath. The finer the solid carbons are ground the better that the alcohols will beneficiate and clean both coke or coal solids. Suspension properties of either coke-alcohol or coal-alcohol in a transportation or storage slurry of mixed alcohols are further increased by a finer grind of the solid particles.

Petroleum coke is a by-product of the oil refining process. Delayed coking, the most widely used process, uses heavy residual oil as a feedstock. The coal can be bituminous, anthracite or lignite variety.

The amount of coke or coal particles in the slurry is 50%-75% by weight. The remaining 50%-25% by weight are the mixed alcohols. A preferred slurry is 65% ground coke or coal and 35% mixed alcohols by weight.

Both the coke-alcohol and coal-alcohol fuels encompass various types of stable suspensions of any rank of coke or coal or mixed alcohols as well as the solids and liquid fuels derived from them.

The invention of the use of mixed alcohol fuel as a blend stock to hydrocarbons improves and enriches the properties of both petroleum coke and coal when combusted or gasified. It serves as a highly efficient freeze-proof media to transport ground coke or coal as a slurry with mixed alcohols by pipeline, rail, barge, tanker or ship. At the destination, heat from the waste or other source separates the coke or coal from all, one, or a sequence of the mixed alcohols as desired for any number of conceived combustion or gasification applications. The ground coke or coal, which is highly activated and beneficiated (such as by diminishing water contamination and driving off nitrogen and sulfurs) in the processing with mixed alcohols, can be combusted in new or retrofitted furnaces, kilns or boilers but preferably in special combined cycle operations. In combined cycles, the fuel mixed alcohols in total or any of its components, singly or combined, are combusted in a gas turbine generator and the separated pulverized coke or coal fires a combustion boiler supplying power to a steam turbine electrical generator.

Use of the coke-alcohol or coal-alcohol fuel provides higher combustion efficiency with lower environmental impact per unit of power output. Furthermore, in contrast to a transportation complex of coal-water slurries, the coke-alcohol or coal-alcohol fuel comprised of its uniquely invented mixed alcohol formula transfers only fuel and conserves water at the origin. The coke-alcohol and coal-alcohol fuel both provide a higher BTU content with relatively less sulfur, nitrogen and particulate matter. Use of higher mixed alcohols blended with either coke or coal serves to mitigate air, water and land pollution.

The beneficiated petroleum coke or coal can be separated from the higher mixed alcohols as desired for applications for gasification to synthesis gas or for combustion in furnaces, kilns or boilers.

The higher mixed alcohols would be separated from solid coke or coal through either vacuum filtration or centrifuge. The remaining percentage of mixed alcohols present in the solid fuel would increase its combustion efficiency and also reduce harmful emissions. The coal-alcohol or coke-alcohol fuels may be stored for long periods of time without the settling or floating of solid particles thus the fuel will easily flow through positive displacement pumps.

The mixed alcohols can also be used as a fuel blendstock or a thinning agent for viscous hydrocarbons such as petroleum crude oil or bitumen. Some crude oils are heavy, meaning that it is dense and has a high viscosity. Some heavy crude oils must be heated to become fluid. Tar sands are saturated with bitumen, a dark, asphalt-like oil. Bitumen is a hydrocarbon with a high viscosity.

By mixing the mixed alcohols of any of the formulas I-IX into crude oil or bitumen, the crude oil and bitumen will flow easier and consequently be less expensive to transport. For example, the blend stock can be transported in pipelines. Heating requirements are reduced if not eliminated.

Once the fuel blend stock reaches its destination, it can be used with the mixed alcohols. Alternatively, the mixed alcohols can be separated from the crude oil or bitumen by heating. For example, the first heat of a refinery can be used to separate out the mixed alcohols. Once separated, the mixed alcohols can be reblended into refined petroleum hydrocarbon products.

The foregoing disclosures and examples are merely illustrative of the principles of this invention and are not to be interpreted in a limiting sense.

The invention claimed is:

1. A fuel for use in internal combustion engines, comprising:
a) gasoline;
b) a mixture of alcohols comprising by volume:
0.01-55% methanol
0.01-80% ethanol
0.01-35% propanol
0.01-30% butanol
0.01-20% pentanol
0.01-15% hexanol
0.01-13% heptanol
0.01-10% octanol
0.01-6% nananol
0.01-5% decanol.

2. The fuel of claim 1 wherein the fuel contains at least 5% by volume of the mixed alcohols and the octane number of the gasoline fuel is greater than 90.

3. The fuel of claim 1 wherein the mixture of alcohols comprises 5-50% of the fuel by volume.

4. A fuel for use in diesel engines, comprising:
a) diesel;
b) mixed alcohols comprising by volume:
0.01-55% methanol
0.01-80% ethanol
0.01-35% propanol
0.01-30% butanol
0.01-20% pentanol.

5. The fuel of claim 4 wherein the mixed alcohols comprise 2-30% of the diesel fuel by volume.

6. The fuel of claim 4 wherein the mixed alcohols further comprises, by volume:
0.01-15% hexanol
0.01-13% heptanol
0.01-10% octanol.

7. The fuel of claim 6 wherein the mixed alcohols further comprise by volume:
0.01-6% nananol
0.01-5% decanol.

8. The fuel of claim 4 wherein the diesel comprises synthetic diesel.

9. The fuel of claim 4 wherein the diesel comprises biodiesel.

10. A fuel for use in diesel engines, comprising:
a) diesel;
b) mixed alcohols with percentages by volume:
0.01-55% methanol
0.01-80% ethanol
0.01-35% propanol
0.01-30% butanol
0.01-20% pentanol.

11. The fuel of claim 10 wherein the mixed alcohols comprise 2-30% of the diesel fuel by volume.

12. The fuel of claim 10 wherein the mixed alcohols further comprises, by volume:
0.01-15% hexanol
0.01-13% heptanol
0.01-10% octanol.

13. The fuel of claim 12 wherein the mixed alcohols further comprises by volume:
0.01-6% nananol
0.01-5% decanol.

14. The fuel of claim 10 wherein the diesel comprises synthetic diesel.

15. The fuel of claim 10 wherein the diesel comprises biodiesel.

16. A mixed alcohol neat fuel for use in an internal combustion engine, comprising, by volume:
0.01-55% methanol
0.01-80% ethanol
0.01-35% propanol
0.01-30% butanol
0.01-20% pentanol
0.01-15% hexanol
0.01-13% heptanol
0.01-10% octanol
0.01-6% nananol
0.01-5% decanol.

17. A jet fuel for use in a jet turbine engine, comprising:
a) kerosene;
b) a mixture of alcohols comprising by volume:
0.01-55% methanol
0.01-80% ethanol
0.01-35% propanol
0.01-30% butanol
0.01-20% pentanol.

18. The jet fuel of claim 17 wherein the mixture of alcohols by volume, further comprises:
0.01-15% hexanol
0.01-13% heptanol
0.01-10% octanol.

19. The jet fuel of claim 18 wherein the mixed alcohols further comprise by volume:
0.01-6% nananol
0.01-5% decanol.

20. A jet fuel for use in a jet turbine engine, comprising:
a) kerosene;
b) mixed alcohols with percentages by volume:
0.01-55% methanol
0.01-80% ethanol
0.01-35% propanol
0.01-30% butanol
0.01-20% pentanol.

21. The jet fuel of claim 20 wherein the mixed alcohols further comprises:
0.01-15% hexanol
0.01-13% heptanol
0.01-10% octanol.

22. The jet fuel of claim 21 wherein the mixed alcohols further comprises:
0.01-6% nananol
0.01-5% decanol.

23. A fuel for use in heating furnaces or boilers, comprising:
a) heating oil;
b) mixed alcohols comprising by volume:
0.01-55% methanol
0.01-80% ethanol
0.01-35% propanol
0.01-30% butanol
0.01-20% pentanol.

24. The heating fuel of claim 23 wherein the mixed alcohols by volume, further comprises:
0.01-15% hexanol
0.01-13% heptanol
0.01-10% octanol.

25. A fuel for use in heating furnaces or boilers, comprising:
a) heating oil;
b) mixed alcohols with percentages by volume:
0.01-55% methanol
0.01-80% ethanol
0.01-35% propanol
0.01-30% butanol
0.01-20% pentanol.

26. The heating fuel of claim 25 wherein the mixed alcohols by volume, further comprises:
0.01-15% hexanol
0.01-13% heptanol
0.01-10% octanol.

27. The heating fuel of claim 26 wherein the mixed alcohols further comprise by volume:
0.01-6% nananol
0.01-5% decanol.

28. A fuel for use in heating furnaces and boilers, comprising:
a) bunker oil;
b) mixed alcohols comprising by volume:
0.01-55% methanol
0.01-80% ethanol
0.01-35% propanol
0.01-30% butanol
0.01-20% pentanol.

29. The fuel of claim 28 wherein the mixture of alcohols by volume, further comprises:
0.01-15% hexanol
0.01-13% heptanol
0.01-10% octanol.

30. The fuel of claim 29 wherein the mixed alcohols further comprise by volume:
0.01-6% nananol
0.01-5% decanol.

31. A fuel for use in heating furnaces and boilers, comprising:
a) bunker oil;
b) mixed alcohols with percentages by volume:
0.01-55% methanol
0.01-80% ethanol
0.01-35% propanol
0.01-30% butanol
0.01-20% pentanol.

32. The fuel of claim 31 wherein the mixture of alcohols by volume, further comprises:
0.01-15% hexanol
0.01-13% heptanol
0.01-10% octanol.

33. The fuel of claim 32 wherein the mixed alcohols further comprise by volume:
0.01-6% nananol
0.01-5% decanol.

34. A fuel for a furnace, kiln, boiler or gasifier, comprising:
a) coke particles;
b) mixed alcohols comprising by volume:
0.01-55% methanol
0.01-80% ethanol
0.01-35% propanol
0.01-30% butanol
0.01-20% pentanol.

35. The fuel of claim 34 wherein the mixture of alcohols by volume, further comprises:
0.01-15% hexanol
0.01-13% heptanol
0.01-10% octanol.

36. The fuel of claim 35 wherein the mixed alcohols further comprise by volume:
0.01-6% nananol
0.01-5% decanol.

37. A fuel for a furnace, kiln, boiler or gasifier, comprising:
a) coke particles;
b) mixed alcohols with percentages by volume:
0.01-55% methanol
0.01-80% ethanol
0.01-35% propanol
0.01-30% butanol
0.01-20% pentanol.

38. The fuel of claim 37 wherein the mixture of alcohols by volume, further comprises:
0.01-15% hexanol
0.01-13% heptanol
0.01-10% octanol.

39. The fuel of claim 38 wherein the mixed alcohols further comprise by volume:
0.01-6% nananol
0.01-5% decanol.

40. A fuel for a furnace, kiln, boiler or gasifier fuel, comprising:
a) coal particles or coal slurry;
b) mixed alcohols comprising by volume:
0.01-55% methanol
0.01-80% ethanol
0.01-35% propanol
0.01-30% butanol
0.01-20% pentanol.

41. The fuel of claim 40 wherein the mixture of alcohols by volume, further comprises:
0.01-15% hexanol
0.01-13% heptanol
0.01-10% octanol.

42. The fuel of claim 41 wherein the mixed alcohols further comprise by volume:

0.01-6% nananol 0.01-5% decanol.

43. A fuel for a furnace, kiln, boiler or gasifier fuel, comprising:

a) coal particles or coal slurry;

b) mixed alcohols with percentages by volume:

0.01-55% methanol 0.01-80% ethanol 0.01-35% propanol 0.01-30% butanol 0.01-20% pentanol.

44. The fuel of claim 43 wherein the mixture of alcohols by volume, further comprises:

0.01-15% hexanol 0.01-13% heptanol 0.01-10% octanol.

45. The fuel of claim 44 wherein the mixed alcohols further comprise by volume:

0.01-6% nananol 0.01-5% decanol.

46. A hydrocarbon blendstock comprising:

a) crude oil or bitumen;

b) mixed alcohols, comprising, by volume:

0.01-55% methanol 0.01-80% ethanol 0.01-35% propanol 0.01-30% butanol 0.01-20% pentanol.

47. The blendstock of claim 46 wherein the mixture of alcohols by volume, further comprises:

0.01-15% hexanol 0.01-13% heptanol 0.01-10% octanol.

48. The fuel of claim 47 wherein the mixture of alcohols by volume, further comprises:

0.01-6% nananol 0.01-5% decanol.

49. A hydrocarbon blendstock comprising:

a) crude oil or bitumen;

b) mixed alcohols with percentages by volume:

0.01-55% methanol 0.01-80% ethanol 0.01-35% propanol 0.01-30% butanol 0.01-20% pentanol.

* * * * *

UNITED STATES PATENT AND TRADEMARK OFFICE

CERTIFICATE OF CORRECTION

PATENT NO. : 8,277,522 B2
APPLICATION NO. : 12/498850
DATED : October 2, 2012
INVENTOR(S) : Robert M. Jimeson et al.

It is certified that error appears in the above-identified patent and that said Letters Patent is hereby corrected as shown below:

On the Title Page one of the inventor's names is misspelled and incorrect in Item (75).

It should appear as follows:

Geradette Giardino

Signed and Sealed this
Twelfth Day of February, 2013

Teresa Stanek Rea
*Acting Director of the United States Patent and Trademark Office*